United States Patent [19]

Richter

[11] 4,358,061

[45] Nov. 9, 1982

[54] MEAT GRINDER

[75] Inventor: Karl Richter, Kleinostheim, Fed. Rep. of Germany

[73] Assignee: Eisenwerke Fried. Wilh. Duker GmbH & Co., Karlstadt, Fed. Rep. of Germany

[21] Appl. No.: 136,290

[22] Filed: Apr. 1, 1980

[51] Int. Cl.[3] ..... B02C 18/36

[52] U.S. Cl. ..... 241/82.4; 241/82.5

[58] Field of Search ..... 241/82.1–82.7, 241/89.4; 17/46, 1 G; 99/516, 518

[56] References Cited

U.S. PATENT DOCUMENTS

| | | | |
|---|---|---|---|
| 3,847,360 | 11/1974 | Seydelmann | 241/82.5 |
| 4,004,742 | 1/1977 | Hess | 241/82.5 |
| 4,202,502 | 5/1980 | Laska | 241/82.5 |

FOREIGN PATENT DOCUMENTS

| | | |
|---|---|---|
| 2154353 | 6/1973 | Fed. Rep. of Germany . |
| 2344284 | 3/1975 | Fed. Rep. of Germany . |
| 2656991 | 6/1978 | Fed. Rep. of Germany . |

*Primary Examiner*—Mark Rosenbaum

*Attorney, Agent, or Firm*—Holman & Stern

[57] ABSTRACT

The instant invention is concerned with a cutting machine, and in particular with a meat grinder, having a cutting assembly arranged along a central axis of the meat grinder. The material to be ground is fed towards the cutting assembly which has at least one perforated disk provided with a central boss bore. At least one cutting blade rotates on a drive shaft in front of the first frontal area of the perforated disk. Separation and removal of the accumulated solid particles contained in the material being cut in front of the first frontal area is provided by the cutting blade and by channels or holes located in the area of the central axis.

4 Claims, 3 Drawing Figures

MEAT GRINDER

BRIEF SUMMARY OF THE INVENTION

Various types of meat grinders are known in the art, in which a separating of hard particles contained in the cutting material is proposed. According to German Offenlegungsschrift No. 26 56 991, there have been provided for this purpose channels in the cutting wings of the cutting blades, which cooperate with an annular channel in the housing of the meat grinder. In a further meat grinder (German Offenlegungsschrift No. 26 49 305, shown in there is provided a collecting groove in the perforated disk, through which the hard particles are guided to a closed blind hole as a collecting container. A substantially more costly type of collecting groove, which additionally is intended to serve for a substantial crushing of the hard particles, is disclosed in German Offenlegungsschrift No. 23 44 284. While in the first and the third case, a costly construction with complicated removal passages are required for the removal of hard particles, no continuous operation of the meat grinder is possible in the second case.

In order to remove these disadvantages partially, in a further prior art meat grinder (German Offenlegungsschrift No. 21 54 353), the cutting blade is formed by a cutting blade flank extending from a cutter. This cutter which is arranged in a tubular fashion around the central axis of the meat grinder, and which has a comparatively large axial extent, protrudes through the boss bore of the perforated disk. A groove shaped like a helical screw, extending at the cutting blade flank beginning along the outer circumference of the tubular cutter, and through the boss bore of the perforated disk, is provided as an outlet means for the hard particles which collect in front of the first frontal area of the perforated disk. However, such an outlet means, which utilizes grooves of a comparatively small cross-section and of a comparatively large length, is not considered as sufficient.

It is the object of the present invention to provide a grinding machine of the above-mentioned type in which, while overcoming the above-noted disadvantages, it will be possible also to provide for an outlet means which can handle larger amounts of solid particles, and in which only a short length of passage has to be overcome.

This problem is solved by the outlet means comprising at least one outlet channel representing a large opening in comparison to the holes in the perforated disk, and penetrating the perforated disk near the boss bore generally in an axial direction.

In this invention, the hard particles have only a short passage through the outlet channels of the axial thickness of the perforated disk, in order to be removed from the material to be ground. This allows the removal of larger amounts of hard particles, whereby the danger of plugging up the outlet means for the hard particles is completely prevented. Additionally, it provides the advantage of simplicity in its construction. In this regard, an especially favorable structure is obtained in an advantageous manner in that the outlet channels are formed by means of three outlet holes which are distributed symmetrically around the boss bore.

In a further suitable embodiment of the present invention, there is provided a counter-ring, which does not substantially cover up the holes of the perforated disk, and which is arranged on the second frontal side of the perforated disk opposite the first frontal side and which is provided with outlet openings which overlap the outlet channels, and by means of which the outlet channels, in accordance with its adjustment, can be adjusted continuously between an opened and a closed position.

It is thus possible that for the various types of material to be ground or cut, such as for example, various types of meats from which various solid particles have to be removed, to adapt the effective area of the outlet channels precisely and continuously to the individual requirements.

It is thereby furthermore of a great advantage that the counter-ring is provided with a central thick-walled pipe piece being rotatable about the central axis, and in the inner circumference of which the outlet openings are in the form of outlet grooves. In addition to the especially structural simplicity by which such type of counter-ring is characterized, an outlet hose can be pushed onto the free end portion of the central pipe piece so that a delivery into a container placed further away is possible. The necessity for this exists in the practice for the reason that usually in the immediate vicinity of the perforated disk of the grinder there stands a container for catching the ground material, so that the container for the solid particles must be placed at a certain distance from the perforated disk.

It has furthermore been proven as advantageous in a grinding machine of the above-mentioned type, in which the cutter blades are provided with cutter flanks extending outwardly from a central receiving hole for the drive shaft, whereby the cutting edges of said cutter flanks rotate on the first frontal area of the perforated disk, to increase the separating effect and the transport of the hard particles through the outlet channels in that the hard particles can be supplied to the outlet channels by means of the cutting edges which extend to the receiving holes and in general are tangential to said receiving holes. Since the cutting edges are thusly extended beyond the cutting flanks in an axial direction and in the area of the outlet channels, they have the effect of protruding blades which, in the rotational direction of the cutting blade, push the hard particles in front of them and effectively to the outlet channels.

BRIEF DESCRIPTION OF THE SEVERAL VIEWS OF THE DRAWINGS

Additional details, advantages and characteristics of the present invention are seen from the following description and the drawings, with special reference being made to all details not described in the text, and wherein.

DETAILED DESCRIPTION

Figure 1:
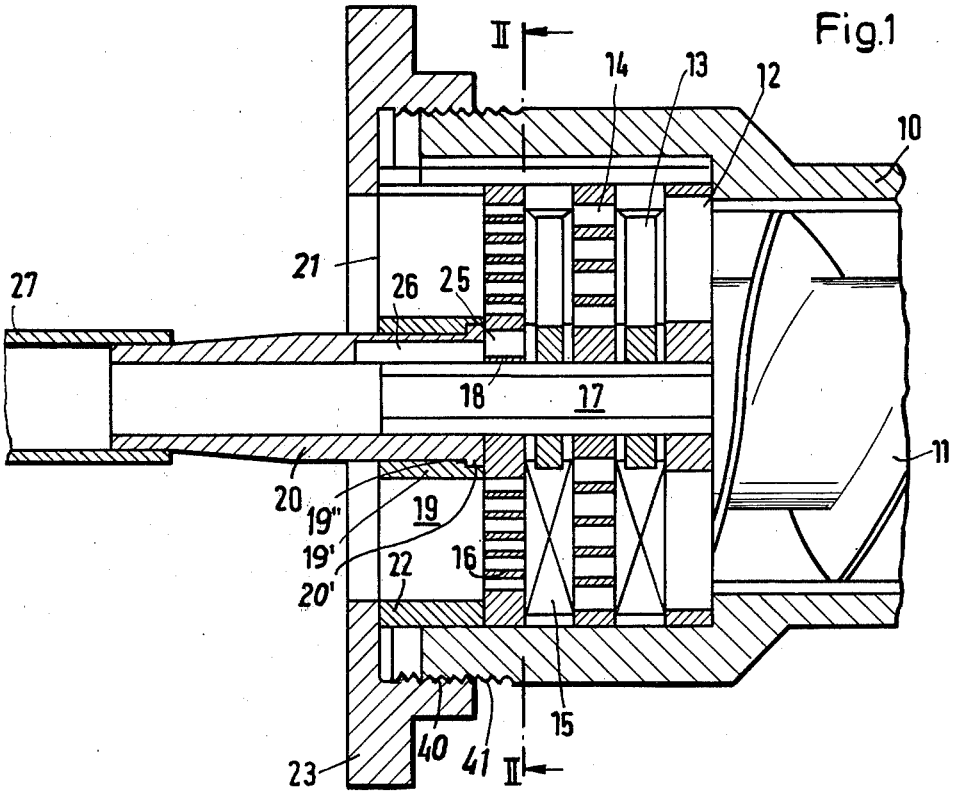
FIG. 1 shows a cross-sectional view of a housing part of a meat grinder having a dual set of cutters, a helix and an adjustable counter-ring.

As seen in FIG. 1, an auger 11 in the direction along the central axis, is located in a housing part 10, which housing is arranged along a central axis of the grinding machine. Seen in the direction of movement, and in a centered arrangement about the central axis are following consecutively an outlet disk 12 which is formed by means of an inner ring near the central axis, and an outer ring near the housing, connected with the inner ring by a few cross pieces; an initial cutter blade 13, a disk 14 having larger holes, a cutter blade 15, and a perforated disk 16, so that a dual cutting set is formed. A drive shaft 17 extends along the central axis from the auger 11 up to the perforated disk 16, and through a central boss bore 18 of the perforated disk 16.

Adjacent to the perforated disk 16 seen in the direction the cut material moves, is located a counter-ring 19 which surrounds a central thickwalled pipe piece 20 and is provided with an inner ring 19' and a coaxial outer ring 22 connected by means of cross pieces 21 with the inner ring 19'. The outer ring 22 is situated near the inside wall of the housing part 10 and has the same outer diameter as the perforated disk 16. The entire arrangement comprising the counter-ring 19 and the dual cutting set is secured in the housing part 10 by means of a screw collar ring 23 having internal threads 40 engaging external threads 41 on the end of housing 10. As the pipe piece 20 is provided with an annular flange 20', with a shoulder 19'' of the inner ring 19' of the counter-ring 19 abutting said annular flange 20', also the pipe piece 20 is secured axially, while it is rotatable about the central axis.

Figure 2:
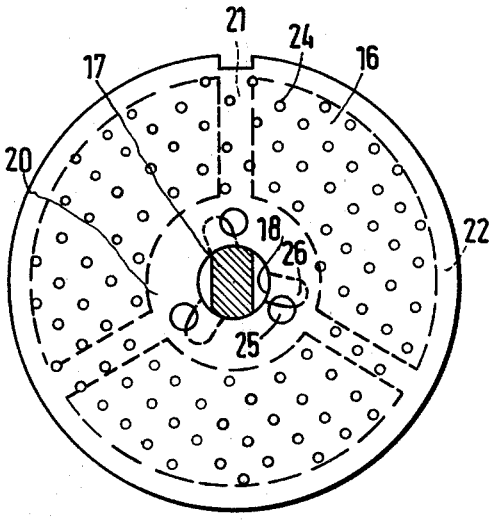
FIG. 2 shows a view along the line II—II of FIG. 1 of a perforated disk for grinding material in the direction of flow, with adjustable counter-ring located behind said disk, partially covering the outlet holes.

As seen in detail in FIG. 2, the perforated disk 16 is provided with an area penetrated with smaller holes 24 and extending close to the boss bore 18, as well as an area without holes which is adjacent the area containing the holes 24 and surrounding the boss bore. In the area which is void of holes, are provided outlet channels near the bore 18 in the form of three outlet holes 25 distributed in a symmetrical arrangement around the bore 18, the outlet holes, in comparison to the small holes 24, representing comparatively large openings. The central thick-walled pipe piece 20 is provided with outlet openings 26 which are overlapping with the outlet channels 25, said outlet openings being formed in the shape of outlet holes in the inner circumference of the thick-walled pipe piece 20, The cross pieces 21 are of small dimensions so that they do not substantially cover up the small holes 24 in the perforated disk 16.

During operation of the grinding machine, the material to be ground is guided to the cutting set by means of the auger 11 whereby the outlet disk 12, due to its large outlet openings, allows the material to be ground to move to the intial cutting blade 13, from where it is guided, after being initially ground, through the disk with larger holes 14 to the cutting blade 15, and finally, after passing through the perforated disk 16, having obtained the finally-ground condition. Hard particles contained in the material to be ground, such as tendons, fibers, gristle and bone splinters in case of meat, during operation of the machine, collect around the central axis and reach the outlet channels 25, moving through the same and reach then the outlet openings 26 of the thick-walled pipe piece 20 through which they are guided away through a hose 27 which may also be connected to the assembly. Dependent on the setting of the pipe piece 20, which seals the outlet channels to about $\frac{1}{3}$ as in the setting seen in FIG. 2, a precise setting of the fineness of separation is being obtained. Thus, for example, when the outlet channels are completely sealed by the pipe piece 20, no separation takes place, while with a continuous adjustment to the opening of the outlet channels at first only tendons, then tendons and fibers, and finally gristle as well as tendons, fibers, and bone splinters, are removed. The central thick-walled pipe piece 20 is suitably provided at its outer circumference with a scale-plan which indicates the setting. There may also be provided index holes into which engages a spring-loaded bolt for securing the pipe piece 20 in the selected setting.

Figure 3:
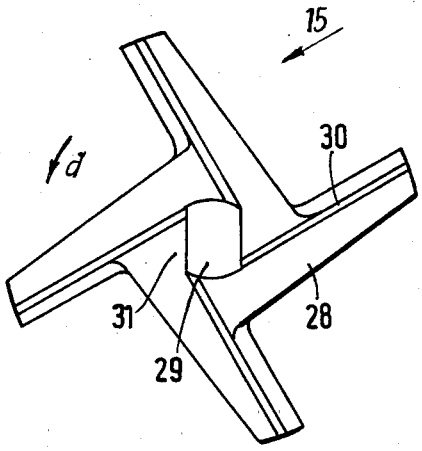
FIG. 3 shows an elevational view of a cutting blade pointing towards the perforated disk.

FIG. 3 shows an embodiment, in which the cutting blade 15 comprises four cutting flanks 28 which are extended substantially radially from a central receiving hole 29 for the drive shaft 17. Cutting edges 30 are provided on the cutter flanks 28 from the outer ends extending up to the receiving hole 29 and in general tangentially thereto. In front of the cutting edges 30 and seen in the rotational direction of the cutting blade 15, in the central area adjacent hole 29 there are depressions 31 by means of which the solid particles to be removed are effectively guided to the outlet channels 25.

The embodiments of the invention wherein exclusive property or privelege is claimed are defined as follows:

1. In a meat grinder, having a housing with a central axis, a rotating helical auger to feed material axially to a cutting assembly arranged co-axially with respect to said auger along the central axis of the meat grinder, at least one perforated disk having a frontal area facing the auger and provided with a central boss, a rotatable drive shaft extending co-axially from said auger receivable in a central bore through said boss, at least one cutting blade driven by said drive shaft in front of the frontal area of the perforated disk between the auger and the perforated disk, whereby the solid particles contained in the material to be cut are separated and collected in front of the frontal area of the perforated disk, the improvement comprising an outlet means located in the vicinity of the central axis comprising at least one outlet channel through said boss of the perforated disk near said bore thereof, said outlet channel having a size comparatively large by comparison with the holes of the perforated disk whereby the solid particles separated and collected in front of the frontal area of the perforated disk pass through said outlet channel, a counter-ring co-axial with and adjacent to the perforated disk on the side opposite the frontal area, said counter-ring being substantially open in the area of the perforations to avoid blocking the perforations in said perforated disk, a central, thick-walled pipe piece rotatably mounted within said counter-ring and being rotatable around the central axis, outlet openings in said pipe piece which overlap said at least one outlet channel in the perforated disk, said pipe piece being rotatably adjustable to adjust the amount of said overlap and thereby the effective size of said at least one outlet channel.

2. The meat grinder according to claim 1, wherein said outlet means comprises three outlet channels symmetrically arranged around said bore.

3. The meat grinder according to claim 1 or 2, wherein the counter-ring has an inner ring part provided with a shoulder on its inner ends, an annular flange on the inner end of said pipe piece said shoulder abutting said flange to retain said pipe piece axially.

4. The meat grinder according to claim 1 or 2, wherein said counter-ring comprises an inner ring, an outer ring and radial members connecting said rings, said outlet openings in said pipe piece extend axially and are open along their entire length to the interior of said pipe, said cutting blade comprises substantially radially extending flanks, cutting edges on said flanks extending substantially tangentially from said drive shaft, and depressions in the central region of said blade in front of said cutting edges in the rotational direction so that said cutting edges and said depressions guide the solid particles to said outlet channels.

* * * * *